US008831856B2

(12) United States Patent
Yasuda et al.

(10) Patent No.: US 8,831,856 B2
(45) Date of Patent: Sep. 9, 2014

(54) CONTROL APPARATUS FOR INTERNAL COMBUSTION ENGINE USING ESTIMATED QUANTITY OF HEAT GENERATED

(75) Inventors: Hiromichi Yasuda, Gotemba (JP); Yusuke Suzuki, Hadano (JP); Soichiro Tanaka, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 613 days.

(21) Appl. No.: 13/002,228

(22) PCT Filed: Apr. 19, 2010

(86) PCT No.: PCT/JP2010/056946

§ 371 (c)(1),
(2), (4) Date: Dec. 30, 2010

(87) PCT Pub. No.: WO2011/132253

PCT Pub. Date: Oct. 27, 2011

(65) Prior Publication Data

US 2012/0046850 A1 Feb. 23, 2012

(51) Int. Cl.
*F02D 28/00* (2006.01)

(52) U.S. Cl.
USPC ..... 701/102; 123/435; 701/103; 73/114.16

(58) Field of Classification Search
CPC ... F02D 35/023; F02D 35/024; F02D 35/028; F02D 41/0255; F02D 41/1458; F02D 2200/0612; F02P 5/153
USPC ..... 123/435, 406.22, 406.26, 406.3, 123/406.31, 406.41, 406.42, 434, 673, 676, 123/677, 678, 679; 701/101–105, 108, 111, 701/113, 114; 73/114.16, 114.17, 114.52, 73/114.53, 114.72, 114.76, 114.01; 702/182, 183
See application file for complete search history.

(56) References Cited

U.S. PATENT DOCUMENTS 4,976,241 A * 12/1990 Ishida et al. ..... 123/406.37
5,020,360 A * 6/1991 Brosi et al. ..... 73/114.16
5,067,463 A * 11/1991 Remboski et al. ..... 123/406.28
5,544,635 A * 8/1996 Hara et al. ..... 123/406.26
6,089,077 A * 7/2000 Daniels ..... 73/35.08

(Continued)

FOREIGN PATENT DOCUMENTS

JP 01216073 A * 8/1989
JP 2004-100567 A 4/2004

(Continued)

*Primary Examiner* — Mahmoud Gimie
*Assistant Examiner* — John Zaleskas
(74) *Attorney, Agent, or Firm* — Sughrue Mion, PLLC

(57) ABSTRACT

An apparatus for controlling an internal combustion engine that can estimate a quantity of heat generated is provided. An arithmetic processing unit 20 can calculate $PV^{\kappa}$ variable according to a crank angle θ and $dPV^{\kappa}/d\theta$ as a rate of change in $PV^{\kappa}$. For convenience' sake, a "crank angle at which $dPV^{\kappa}/d\theta$ is a maximum while $PV^{\kappa}$ is increasing" is to mean a "crank angle at a combustion proportion of 50%" and be referred to also as "$\theta_{CA50}$". $PV^{\kappa}$ calculated for $\theta_{CA50}$ is to be referred to also as "$PV^{\kappa}_{CA50}$". In addition, for convenience' sake, a difference between $PV^{\kappa}$ (which is zero in the embodiment as shown in FIGS. 3 and 4) and $PV^{\kappa}_{CA50}$ at a start of combustion is also referred to as $\Delta PV^{\kappa}_{CA50}$. A total quantity of heat generated Q is assumed to be twice as much as a value of $\Delta PV^{\kappa}_{CA50}$.

19 Claims, 7 Drawing Sheets

(56) References Cited

U.S. PATENT DOCUMENTS

| | | | | |
|---|---|---|---|---|
| 7,347,185 | B2 * | 3/2008 | Moriya et al. | 123/435 |
| 7,529,613 | B2 * | 5/2009 | Sameshima et al. | 701/102 |
| 8,281,643 | B2 * | 10/2012 | Yasuda | 73/35.02 |
| 2001/0052335 | A1 * | 12/2001 | Miyakubo et al. | 123/305 |
| 2002/0023431 | A1 * | 2/2002 | Takemura et al. | 60/284 |
| 2003/0061869 | A1 * | 4/2003 | Fuerhapter et al. | 73/116 |
| 2005/0229903 | A1 | 10/2005 | Kobayashi et al. | |
| 2006/0150953 | A1 * | 7/2006 | Moriya et al. | 123/435 |
| 2007/0084442 | A1 * | 4/2007 | Nakagawa et al. | 123/406.27 |
| 2007/0124054 | A1 * | 5/2007 | Kassner | 701/103 |
| 2008/0162017 | A1 * | 7/2008 | Nagata et al. | 701/103 |
| 2008/0195294 | A1 * | 8/2008 | Moriya | 701/103 |
| 2008/0289603 | A1 * | 11/2008 | Konakawa | 123/406.26 |
| 2008/0319632 | A1 * | 12/2008 | Miyashita et al. | 701/102 |
| 2009/0266336 | A1 * | 10/2009 | Morimoto et al. | 123/406.47 |
| 2009/0299605 | A1 * | 12/2009 | Kweon et al. | 701/103 |
| 2010/0071659 | A1 * | 3/2010 | Moriya et al. | 123/406.41 |
| 2010/0089363 | A1 * | 4/2010 | Moriya | 123/435 |
| 2010/0241333 | A1 * | 9/2010 | Moriya et al. | 701/101 |

FOREIGN PATENT DOCUMENTS

| | | | | |
|---|---|---|---|---|
| JP | 2006-144643 | A | | 6/2006 |
| JP | 2007032531 | A | * | 2/2007 |
| JP | 2007-113396 | A | | 5/2007 |
| JP | 2007-120392 | A | | 5/2007 |
| JP | 2008-025406 | A | | 2/2008 |
| JP | 2008144712 | A | * | 6/2008 |

* cited by examiner

CONTROL APPARATUS FOR INTERNAL COMBUSTION ENGINE USING ESTIMATED QUANTITY OF HEAT GENERATED

TECHNICAL FIELD

The present invention relates to a control apparatus for an internal combustion engine.

BACKGROUND ART

A technique is known that obtains various types of information on a quantity of heat during the combustion in an internal combustion engine as disclosed, for example, in JP-A-2006-144643. Specifically, the above-referenced publication discloses a technique that uses an output value from an in-cylinder pressure sensor to calculate a calorific value immediately after the completion of combustion and calculates a combustion air-fuel ratio based on the calorific value thereby obtained.

PRIOR ART DOCUMENTS

Patent Documents

[Patent Document 1]
JP-A-2006-144643
[Patent Document 2]
JP-A-2007-120392
[Patent Document 3]
JP-A-2007-113396

SUMMARY OF THE INVENTION

Technical Problem

Known techniques obtain a quantity of heat generated as a result of combustion in the internal combustion engine and use the quantity for various types of control of the internal combustion engine. During the combustion in the internal combustion engine, the quantity of heat generated increases over a period of from the start to end of combustion. The quantity of heat generated may be used, for example, for calculating the combustion air-fuel ratio as in the above-described technique.

The quantity of heat generated can be obtained based on an amount of change (difference) in the quantity of heat between the start of combustion and the end of combustion. A known technique for calculating the quantity of heat generated uses, for example, the output value of the in-cylinder pressure sensor at the end of combustion to thereby detect the quantity of heat generated at the end of combustion. Specifically, this calculating technique obtains the output value of the in-cylinder pressure sensor at the end of combustion and, based on the output value, obtains the quantity of heat generated. The calculation of the quantity of heat generated at the end of combustion using an actual sensor value allows a final quantity of heat generated in a combustion stroke in question to be accurately obtained.

The technique that always requires the value detected by the sensor at the end of combustion, however, allows final results on the quantity of heat generated to be obtained only after the combustion is completed. In addition, under an operating condition in which the end of combustion is fairly delayed as compared with an ordinary operating condition, the end of combustion may be delayed to coincide with valve opening timing of an exhaust valve. In such cases, use of the output value of the in-cylinder pressure sensor has a harmful effect unique only thereto. Specifically, in such cases, it is difficult to clearly determine the end of combustion from the in-cylinder pressure sensor output value or it is inappropriate to use the in-cylinder pressure sensor output value as a basis for calculating the quantity of heat generated at the end of combustion.

The inventors have found, through an extensive research, a technique that presumptively finds the quantity of heat generated by using information available prior to the end of combustion without using the value detected by the in-cylinder pressure sensor at the end of combustion.

The present invention has been made to solve the foregoing problem and it is an object of the present invention to provide a control apparatus for an internal combustion engine that can estimate the quantity of heat generated by using information available prior to the end of combustion.

Solution to Problem

To achieve the above-mentioned purpose, a first aspect of the present invention is an apparatus for controlling an internal combustion engine, comprising:

means for acquiring, as a value representing information on the quantity of heat generated, a quantity of heat generated by the internal combustion engine or a parameter correlating with the quantity of heat generated;

based on a value obtained by multiplying the quantity-of-heat-generated information value at timing at which a rate of change in the quantity-of-heat-generated information value is a maximum value thereof and a predetermined value together, means for estimating a quantity of heat generated after the timing; and means for controlling the internal combustion engine by using the quantity of heat generated estimated with the estimating means.

A second aspect of the present invention is the apparatus according to the first aspect, wherein:

the acquisition means includes:

means for acquiring an output from an in-cylinder pressure sensor attached to the internal combustion engine; and means for acquiring the quantity of heat generated or the parameter based on the output of the in-cylinder pressure sensor acquired by the sensor output acquisition means.

A third aspect of the present invention is the apparatus according to the first or the second aspect, wherein:

the acquisition means includes:

means for acquiring the quantity-of-heat-generated information value at predetermined intervals during operation of the internal combustion engine; and the estimating means includes:

means for identifying, through detection or estimation, a peak point in time at which the rate of change in the quantity-of-heat-generated information value is the maximum value thereof;

means for acquiring, of the quantity-of-heat-generated information values acquired by the acquisition means during the operation of the internal combustion engine, a value at the peak point in time identified by the peak-point-in-time identifying means; and means for finding the quantity of heat generated after the peak point in time through a calculation using the quantity-of-heat-generated information value acquired by the identification information acquisition means and a predetermined coefficient.

A fourth aspect of the present invention is the apparatus according to the third aspect, wherein:

the calculating means includes:

means for finding a quantity of heat generated at an end of combustion based on a value twice as much as the quantity-of-heat-generated information value at the peak point in time identified by the peak-point-in-time identifying means.

A fifth aspect of the present invention is the apparatus according to the third or the fourth aspect, wherein:

the calculating means includes:

means for excluding, from a numeric value used for the calculation for finding the quantity of heat generated, the quantity-of-heat-generated information value acquired by the identification information acquisition means after predetermined timing before the end of combustion in the internal combustion engine.

A sixth aspect of the present invention is the apparatus according to any one of the first to the fifth aspects, further comprising:

means for determining whether or not the end of combustion in the internal combustion engine is delayed, or likely to be delayed, relative to predetermined timing, wherein:

the controlling means controls the internal combustion engine by using the quantity of heat generated acquired by the quantity-of-heat-generated acquisition means, when the determining means determines that the end of combustion is delayed or likely to be delayed relative to the predetermined timing.

A seventh aspect of the present invention is the apparatus according to the sixth aspect, wherein:

the determining means determines that the end of combustion in the internal combustion engine is delayed, or likely to be delayed, relative to the predetermined timing when at least one of following is true: retard of the internal combustion engine is equal to, or more than, a predetermined value; the internal combustion engine is in a process of catalyst warm-up operation; an amount of exhaust gas circulation (EGR) in the internal combustion engine is equal to, or more than, a predetermined value; and the internal combustion engine is in lean-burn operation.

A eighth aspect of the present invention is the apparatus according to any one of the first to the seventh aspects, wherein:

the controlling means includes at least:

means for detecting an air-fuel ratio during combustion in the internal combustion engine by using the quantity of heat generated estimated by the estimating means; or means for detecting properties of fuel of the internal combustion engine by using the quantity of heat generated estimated by the estimating means.

Advantageous Effects of Invention

In the first aspect of the present invention, the quantity of heat generated can be estimated by using the relation that the combustion proportion is 50% when the rate of change in the quantity of heat generated is its maximum.

In the second aspect of the present invention, an estimated value of the quantity of heat generated can be acquired in a configuration for calculating the quantity of heat generated by using the quantity-of-heat-generated information value (the quantity of heat generated or the parameter correlating therewith) obtained from the output of the in-cylinder pressure sensor, even when the end of combustion is delayed.

In the third aspect of the present invention, the timing at which the rate of change in the quantity of heat generated or the rate of change in the parameter correlating with the quantity of heat generated is the maximum value thereof can be clearly identified. The quantity of heat generated at the end of combustion can be calculated based on the quantity of heat generated or the parameter correlating therewith at the timing thus identified.

In the fourth aspect of the present invention, the quantity of heat generated at the end of combustion can be calculated can be accurately obtained through a simple calculation.

In the fifth aspect of the present invention, use of a calculated value of the quantity of heat generated can be terminated a certain period of time before the end of combustion by establishing an end of an interval used for calculation of the quantity of heat generated at a point in time before the end of combustion. This allows the quantity of heat generated to be accurately found even under a condition in which noise of the quantity-of-heat-generated information value increases in a latter part of a combustion stroke.

In the sixth aspect of the present invention, the quantity of heat generated at the end of combustion can be reliably used in controlling the internal combustion engine even when the end of combustion is delayed.

In the seventh aspect of the present invention, a determination as to whether or not the end of combustion in the internal combustion engine is delayed can be made precisely according to a specific situation.

In the eighth aspect of the present invention, early detection of a combustion air-fuel ratio or fuel properties using the quantity of heat generated can be made.

REFERENCE SIGNS LIST

Figure 1:
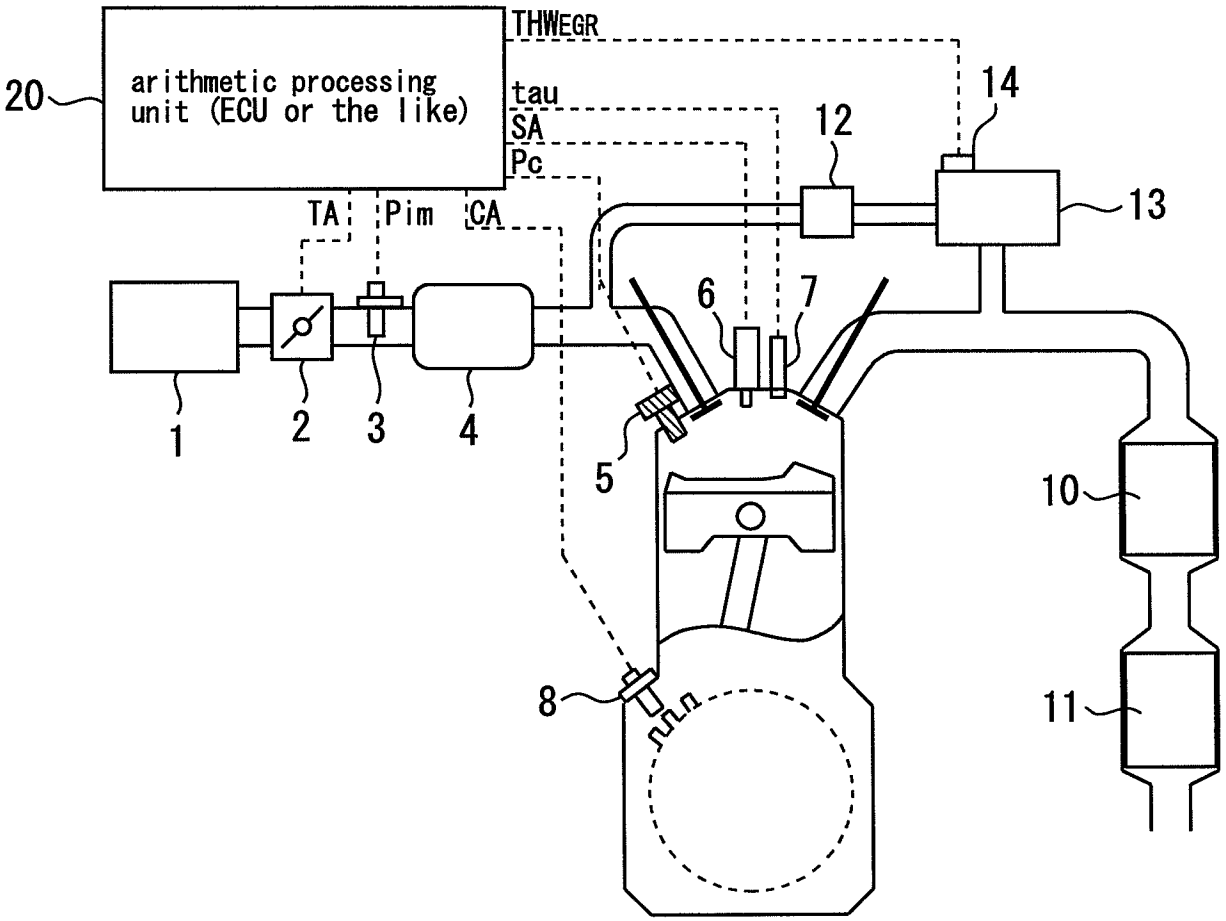
FIG. 1 is a diagram showing a configuration of a control apparatus for an internal combustion engine according to a first embodiment of the present invention.

1 air cleaner
2 throttle valve
3 intake pressure sensor
4 surge tank
5 in-cylinder pressure sensor
6 spark plug
7 direct fuel injector
8 crank angle sensor
10,11 catalyst
12 EGR valve
13 EGR cooler
14 water temperature sensor
20 arithmetic processing unit

DESCRIPTION OF EMBODIMENTS

First Embodiment

Configuration of the First Embodiment

FIG. 1 is a diagram showing a configuration of a control apparatus for an internal combustion engine according to a first embodiment of the present invention. The control apparatus of this embodiment is suitable for controlling an internal combustion engine mounted in a moving unit, such as a vehicle, specifically, an automobile.

FIG. 1 is a diagram showing the internal combustion engine (hereinafter referred to simply as the "engine") to which the control apparatus of this embodiment is applied. The engine shown in FIG. 1 is a spark-ignition type, 4-stroke reciprocating engine having a spark plug 6. The engine is also a direct injection engine having a direct fuel injector 7 that injects fuel directly into a cylinder. The engine to which the present invention is applied is not limited to the direct injection engine of this embodiment. The present invention may also be applied to a port injection engine.

In this engine, an intake valve and an exhaust valve are driven by an intake variable valve actuating mechanism and an exhaust variable valve actuating mechanism not shown, respectively. Each of these variable valve actuating mechanisms includes a variable valve timing (VVT) mechanism and is capable of changing a phase of the intake valve or the exhaust valve within a predetermined range.

Though FIG. 1 shows only one cylinder, ordinary vehicular engines include a plurality of cylinders. At least one of the plurality of cylinders is mounted with an in-cylinder pressure sensor 5 for measuring a cylinder pressure.

The engine further includes a crank angle sensor 8 that outputs a signal according to a rotating angle of a crankshaft. A signal CA from the crank angle sensor 8 may be used for calculating an engine speed (speed per unit time) or a cylinder volume V that is determined by a position of a piston.

An air cleaner 1 is disposed at an inlet of an intake passage connected to the cylinder. A throttle valve 2 is disposed downstream of the air cleaner 1. A surge tank 4 is disposed downstream of the throttle valve 2 and is attached with an intake pressure sensor 3 for measuring an intake pressure. In addition, two catalysts 10, 11 are disposed on an exhaust passage connected to the cylinder. Though not shown, an air-fuel ratio sensor, a sub-oxygen sensor, and other types of exhaust gas sensors may also be disposed.

The engine includes an EGR passage that connects the exhaust passage and the intake passage. The EGR passage includes an EGR cooler 13 and an EGR valve 12. The EGR cooler 13 includes a water temperature sensor 14 for measuring a coolant temperature.

In addition, the engine includes an arithmetic processing unit 20 as a control unit. The arithmetic processing unit 20 processes signals from the sensors 3, 5, 8, 14 and incorporates processing results into operations of the actuators 2, 6, 7, 12 and the abovementioned variable valve actuating mechanisms. The arithmetic processing unit 20 may be what is called an electronic control unit (ECU).

The arithmetic processing unit 20 stores in memory a process for performing an analog-to-digital conversion (A/D conversion) by synchronizing an output signal from the in-cylinder pressure sensor 5 with a crank angle. Performance of this process allows a value of the cylinder pressure at any desired timing to be detected.

The arithmetic processing unit 20 stores in memory a $PV^{\kappa}$ calculating process for calculating a parameter $PV^{\kappa}$ that correlates with the quantity of heat generated. This process can calculate, according to a crank angle $\theta$, a cylinder pressure for each crank angle $P(\theta)$ and a cylinder volume for each crank angle $V(\theta)$. The process can also calculate $P(\theta)\cdot V(\theta)^{\kappa}$ by using a ratio of specific heat $\kappa$. In addition, the arithmetic processing unit 20 stores in memory a process for calculating a rate of change of $P(\theta)\cdot V(\theta)^{\kappa}$. Through this process, a rate of change in the quantity of heat generated $dPV^{\kappa}/d\theta$ can be calculated for any desired timing (crank angle) in a combustion stroke.

The arithmetic processing unit 20 stores in memory a process for finding an air-fuel ratio through the calculation that uses the $PV^{\kappa}$ value. Specifically, this process finds, from the output value of the in-cylinder pressure sensor 5, a heat value during an intake stroke and a heat value immediately after the end of combustion to thereby obtain the air-fuel ratio through calculation. The technique of this kind for detecting the air-fuel ratio is well known, as disclosed in, for example, JP-A-2006-144643 and further descriptions of the same will be omitted.

Operations of the Control Unit According to the First Embodiment

Figure 2:
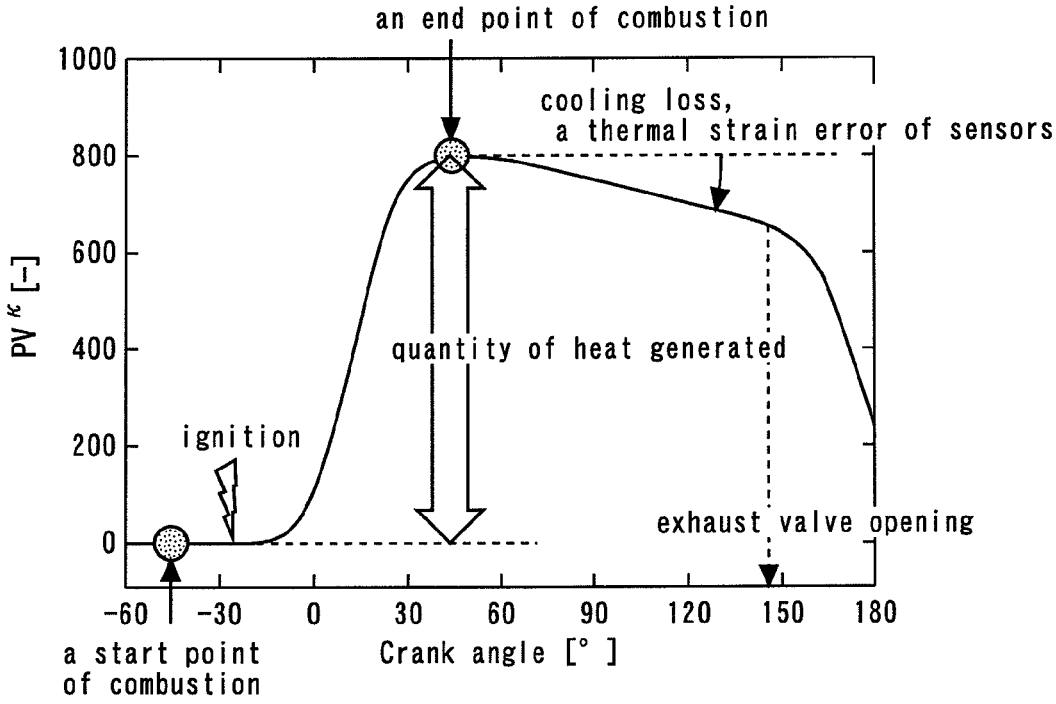
FIG. 2 is a chart for illustrating operations of the control unit according to the first embodiment of the present invention.

FIGS. 2 through 4 are charts for illustrating operations of the control unit according to the first embodiment of the present invention. The quantity of heat generated can be obtained based on an amount of change (difference) between the quantity of heat at a start of combustion and the quantity of heat at an end of combustion. For convenience' sake, the difference between the quantity of heat at the start of combustion and the quantity of heat at the end of combustion will hereinafter be referred to also as a "total quantity of heat generated" and may be represented by a symbol Q. The known technique for calculating the quantity of heat generated uses, for example, the output value of the in-cylinder pressure sensor at the end of combustion to thereby detect the quantity of heat generated at the end of combustion.

The technique that always requires the value detected by the sensor at the end of combustion, however, allows a final conclusion of the quantity of heat generated to be obtained only after the combustion is completed. In addition, under an operating condition in which the end of combustion is fairly delayed as compared with an ordinary operating condition, the end of combustion may be delayed to coincide with valve opening timing of the exhaust valve.

FIG. 2 is a chart showing the concept of a technique for calculating the quantity of heat generated. The quantity of heat generated can be obtained from the amount of change of $PV^{\kappa}$ from the start of combustion to the end of combustion (an arrow in FIG. 2). The start of combustion can be set at ignition timing or timing immediately therebefore. The end of combustion may, for example, be a point in time at which $PV^{\kappa}$ is the greatest from a viewpoint of an effect of cooling loss or an effect of noise (e.g. a thermal strain error of sensors) in an expansion stroke.

It is to be herein noted that a combustion period can become longer in such operating conditions as that makes combustion instable, for example, retarded combustion occurring at such timing as during performance of a catalyst warm-up control, a large-volume exhaust gas recirculation (EGR), and lean burn. The extended combustion period makes it difficult to determine the end of combustion, if combustion lasts until the exhaust valve opens. As a result, under such combustion conditions, it is difficult to calculate accurately the quantity of heat generated at the end of combustion.

Figure 3A:
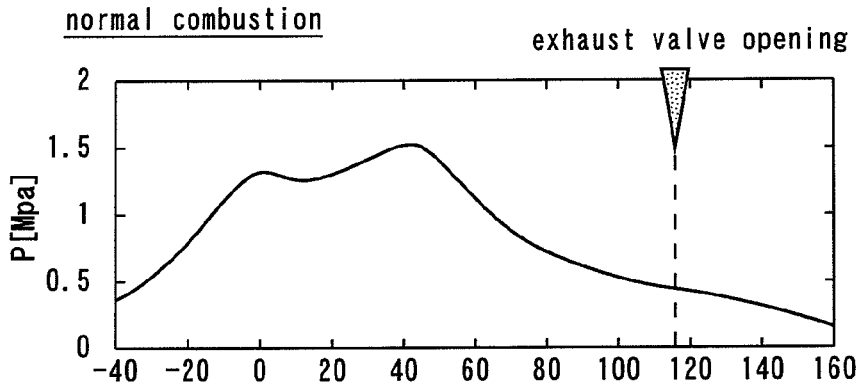
FIG. 3A to 3C are charts for illustrating operations of the control unit according to the first embodiment of the present invention.
Figure 3B:
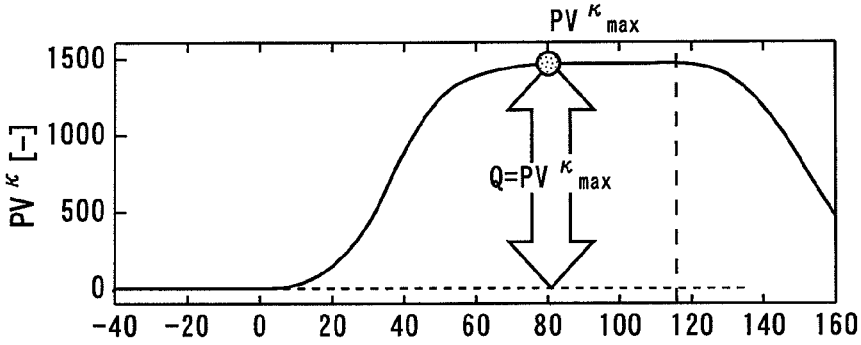
Figure 3C:
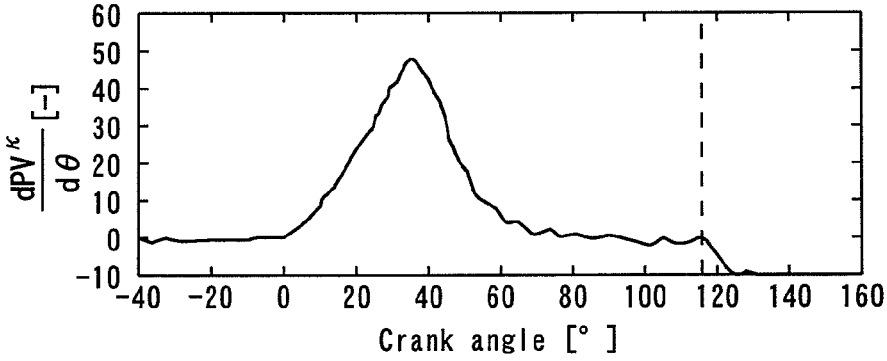
Figure 4A:
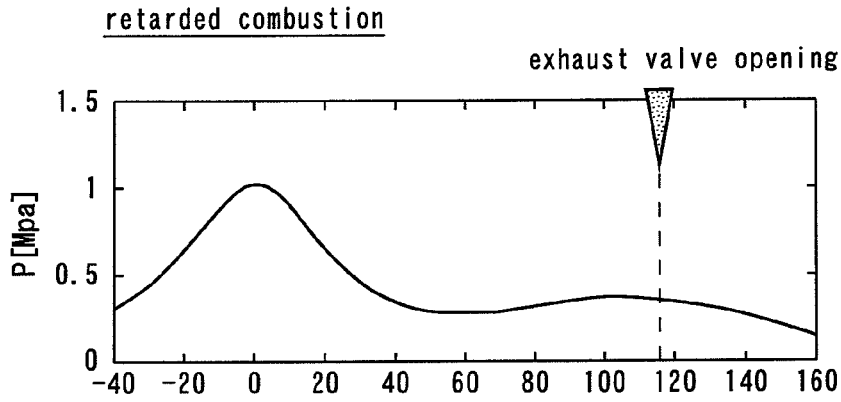
FIG. 4A to 4C are charts for illustrating operations of the control unit according to the first embodiment of the present invention.
Figure 4B:
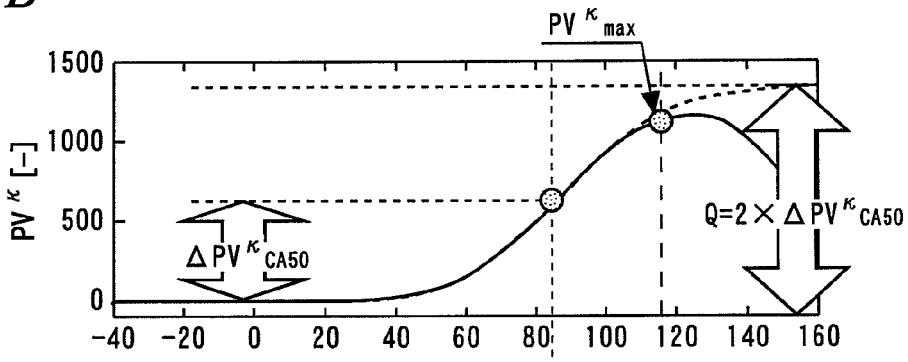
Figure 4C:
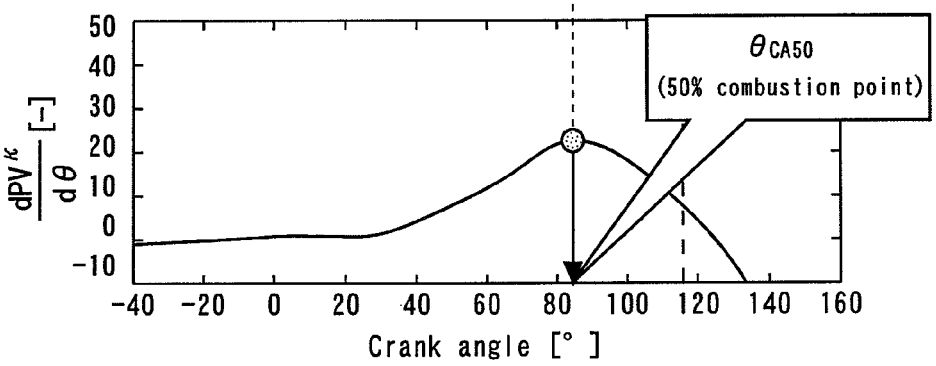

FIG. 3 is a chart showing a waveform of a cylinder pressure P (FIG. 3A), a waveform of $PV^{\kappa}$ (FIG. 3B), and a waveform of the rate of change in the quantity of heat generated $dPV^{\kappa}/d\theta$ (FIG. 3C) under a normal combustion condition at changing crank angles. FIG. 4 is a chart showing a waveform of the cylinder pressure P (FIG. 4A), a waveform of $PV^{\kappa}$ (FIG. 4B), and a waveform of the rate of change in the quantity of heat generated $dPV^{\kappa}/d\theta$ (FIG. 4C) under a retarded combustion condition at changing crank angles.

For the normal combustion condition as shown in FIG. 3, the end of combustion appears well earlier than the crank angle at which the exhaust valve opens. The end of combustion can, as a result, be clearly identified. Therefore, referring to FIG. 3B, the total quantity of heat generated Q can be obtained from a maximum value $PV^{\kappa}_{max}$ of $PV^{\kappa}$ based on the difference (amount of change) of $PV^{\kappa}$ between the start of combustion and the end of combustion. For the retarded combustion condition as shown in FIG. 4, on the other hand, a situation can develop in which the exhaust valve opens at timing at which combustion is still underway. If the exhaust valve opens in the middle of combustion as $PV^{\kappa}$ is being calculated from the output value of the in-cylinder pressure sensor 5, it becomes inappropriate to use the maximum value $PV^{\kappa}_{max}$ for calculating the quantity of heat generated. As shown by a broken line in FIG. 4B, there may be a case in which the quantity of heat generated is greater than $PV^{\kappa}_{max}$.

The inventors have found, through an extensive research, a technique that presumptively finds the quantity of heat generated by using information prior to the end of combustion without having to use the value detected by the sensor at the end of combustion. The inventors focus on a point that a value of the "quantity of heat generated at a crank angle at which the rate of change in a combustion proportion is the greatest" multiplied roughly by 2 can be treated as the total quantity of heat generated Q.

The "combustion proportion" (hereinafter referred to also as an "MFB") is a value defined to be an index indicating combustion progress. Specifically, the combustion proportion varies in a range from 0 to 1 (or, a range from 0% to 100%), a combustion proportion of 0 (0%) indicating the start of combustion and a combustion proportion of 1 (100%) indicating the end of combustion.

$$MFB=(P_{\theta}V_{\theta}^{\kappa}-P_{\theta 0}V_{\theta 0}^{\kappa})/P_{\theta f}V_{\theta f}^{\kappa}-P_{\theta 0}V_{\theta 0}^{\kappa}) \quad (1)$$

In expression (1) shown above, $P_{\theta 0}$ and $V_{\theta 0}$ denote the cylinder pressure P and the cylinder volume V, respectively, when the crank angle θ is a predetermined combustion start timing θ0 and $P_{\theta f}$ and $V_{\theta f}$ denote the cylinder pressure P and the cylinder volume V, respectively, when the crank angle θ is a predetermined combustion end timing θf. In addition, Pθ and Vθ denote the cylinder pressure P and the cylinder volume V, respectively, when the crank angle θ is any given value. κ is the ratio of specific heat.

The inventors focus on a point that the crank angle at a combustion proportion of 50% coincides with that at which the rate of change in the combustion proportion is the greatest, specifically, at which the rate of change of PVκ is the greatest. From this viewpoint, in this embodiment, a crank angle with the greatest value of $dPV^{\kappa}/d\theta$ is identified and the total quantity of heat generated Q is obtained based on a value that is twice as much as $PV^{\kappa}$ at the crank angle.

For convenience' sake, the "crank angle at which $dPV^{\kappa}/d\theta$ is the maximum while $PV^{\kappa}$ is increasing" is to, hereinafter, mean the "crank angle at a combustion proportion of 50%" and be referred to also as "$\theta_{CA50}$". $PV^{\kappa}$ calculated for $\theta_{CA50}$ is to be referred to also as "$PV^{\kappa}_{CA50}$". In addition, for convenience' sake, a difference between $PV^{\kappa}$ (which is zero in this embodiment as shown in FIGS. 3 and 4) and $PV^{\kappa}_{CA50}$ at the start of combustion is also referred to as $\Delta PV^{\kappa}_{CA50}$.

This embodiment assumes that the total quantity of heat generated Q is to be twice as much as a value of $\Delta PV^{\kappa}_{CA50}$ as shown in FIG. 4B. In the first embodiment, therefore, future information on the quantity of heat generated Q can be presumptively obtained by using $PV^{\kappa}_{CA50}$ without using the value detected by the sensor at the end of combustion, specifically, without waiting for the end of combustion. Further, in the first embodiment, in a configuration of calculating the quantity of heat generated by using $PV^{\kappa}$ obtained from the output of the in-cylinder pressure sensor 5, the total quantity of heat generated Q can be presumptively obtained even with a delayed end of combustion as shown in FIG. 4.

Specific Processes of the First Embodiment

Figure 5:
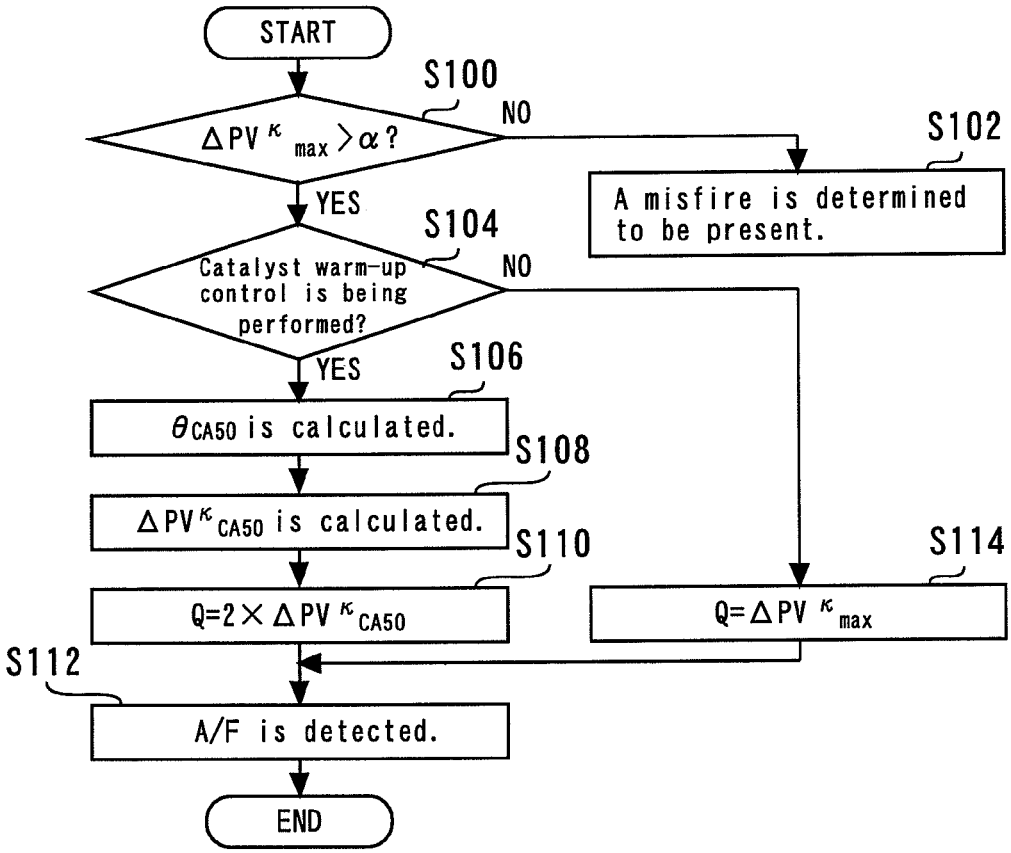
FIG. 5 is a flow chart showing a routine performed by the arithmetic processing unit 20 in the first embodiment of the present invention.

Specific processes performed in the control apparatus for the internal combustion engine according to the first embodiment will be described below with reference to FIG. 5. FIG. 5 is a flow chart showing a routine performed by the arithmetic processing unit 20 in the first embodiment of the present invention.

In the first embodiment, the arithmetic processing unit 20 is configured so as to perform a process for calculating $\Delta PV^{\kappa}_{max}$, in addition to the above-described process for calculating $\Delta PV^{\kappa}_{CA50}$. $\Delta PV^{\kappa}_{max}$ can be calculated by, for example, first storing the maximum value of $P(\theta)\cdot V(\theta)^{\kappa}$ calculated according to the crank angle θ and then finding a difference between the maximum value stored in memory and $P(\theta)\cdot V(\theta)^{\kappa}$ at the start of combustion.

In the routine shown in FIG. 5, it is first determined whether or not $\Delta PV^{\kappa}_{max}$ exceeds a predetermined value α (step S100). In this step, $\Delta PV^{\kappa}_{max}$ is first calculated. If $\Delta PV^{\kappa}_{max}$ is equal to, or less than, the predetermined value α, a misfire is determined to be present (step S102).

If the condition of step S100 holds true, it is next determined whether or not the catalyst warm-up control is being performed (step S104). In this embodiment, the engine shown in FIG. 1 performs the catalyst warm-up control under a predetermined condition. In step S104, it is determined whether or not the catalyst warm-up control is being performed based on a control command from the arithmetic processing unit 20.

If the condition of step S104 does not hold true, the catalyst warm-up control is not being performed, which gives a reason to believe that there is only a small harmful effect on calculation of the quantity of heat generated from a prolonged combustion period as exemplified by using FIG. 4. Thus, this embodiment treats $\Delta PV^{\kappa}_{max}$ as the total quantity of heat generated Q, if the condition of step S104 does not hold true (step S114). This allows an accurate $PV^{\kappa}_{max}$ value to be obtained by using the output value from the in-cylinder pressure sensor 5 at the end of combustion for calculating the quantity of heat generated based on the value actually measured by the in-cylinder pressure sensor 5, while avoiding a harmful effect of degraded accuracy from, for example, the prolonged combustion period.

If the condition of step S104 holds true, $\theta_{CA50}$ is calculated (step S106). The condition of step S104 holds true, which confirms that the catalyst warm-up control is being performed. In processes that follow, therefore, an estimated quantity of heat generated is calculated based on the technique according to the first embodiment described above. As schematically shown in FIG. 4C, each of $dPV^{\kappa}/d\theta$ values according to the crank angle θ is first sequentially calculated by using each value of P(θ) and V(θ) corresponding to the crank angle θ. An increase or decrease in $dPV^{\kappa}/d\theta$ is thereafter monitored to identify the crank angle θ when $dPV^{\kappa}/d\theta$ is its maximum value. The crank angle θ thus identified is treated as $\theta_{CA50}$.

A process for calculating $\Delta PV^{\kappa}_{CA50}$ is next performed (step S108). In this step, $PV^{\kappa}$ at the start of combustion is first identified (which is zero in this embodiment as shown in FIGS. 3 and 4). Next, a difference between $PV^{\kappa}$ and $PV^{\kappa}_{CA50}$ at the start of combustion is obtained and the difference is treated as $\Delta PV^{\kappa}_{CA50}$.

A calculation of "$Q=2\times\Delta PV^{\kappa}_{CA50}$" for obtaining the total quantity of heat generated Q is then performed (step S110). In this step, a value of $\Delta PV^{\kappa}_{CA50}$ calculated in step S108 multiplied by 2 is substituted in the total quantity of heat generated Q. FIG. 4B also schematically represents this calculation.

A process for calculating a combustion air-fuel ratio is thereafter performed (step S112). In this step, the calculation process for finding the air-fuel ratio stored in the arithmetic processing unit 20 is performed by using the value of the total quantity of heat generated Q calculated in step S110 or step S114, whereby the combustion air-fuel ratio is obtained.

Through the foregoing processes, the future information on the quantity of heat generated Q can be presumptively obtained by using $PV^{\kappa}_{CA50}$ as the parameter correlating with the quantity of heat generated at a combustion proportion of 50%, as necessary, instead of $PV^{\kappa}_{max}$ as the parameter correlating with the quantity of heat generated at the end of combustion, without waiting for the end of combustion. Further, the specific processes performed according to the first embodiment as described above allow an estimated value of the total quantity of heat generated Q to be obtained in the configuration performing calculation of the quantity of heat generated by using $PV^{\kappa}$ obtained from the output of the in-cylinder pressure sensor 5, even with a delayed end of combustion as shown in FIG. 4.

In addition, in the specific processes performed according to the first embodiment as described above, through the process of step S106, the timing at which the rate of change of the quantity of heat generated or the rate of change of a parameter correlating therewith is its maximum value can be clearly identified. Based on the quantity of heat generated or the parameter correlating therewith at the timing identified, the total quantity of heat generated Q can be calculated through the processes of steps S108 and 110.

Additionally, in the specific processes performed according to the first embodiment as described above, the quantity of heat generated at the end of combustion can be accurately obtained through a simple calculation of multiplying $\Delta PV^{\kappa}_{CA50}$ by 2. In the first embodiment, the process of step S114 or step S110 is selectively performed depending on whether or not the condition of step S104 is met, which offers an advantage of standardizing the calculation process of $\Delta PV^{\kappa}$.

In the specific processes performed according to the first embodiment as described above, it is determined whether or not the catalyst warm-up control is being performed and, based on the determination made, the process of either step S110 or S114 can be selectively performed. This allows the information on the quantity of heat generated to be reliably used in the control of the internal combustion engine, regardless of whether the end of combustion is delayed or likely to be delayed. Specifically, the information on the quantity of heat generated can be reliably used for calculating the combustion air-fuel ratio.

In the first embodiment described heretofore, $PV^{\kappa}$ corresponds to the "parameter", $dPV^{\kappa}/d\theta$ corresponds to the "rate of change in the quantity of heat generated information value", $\theta_{CA50}$ corresponds to the "timing at which the rate of change in the quantity-of-heat-generated information value is a maximum value thereof", and the "$PV^{\kappa}$ calculating process" stored in the arithmetic processing unit 20 corresponds to the "acquisition means", respectively, of the first aspect of the present invention. Additionally, in the first embodiment described above, the arithmetic processing unit 20 performs the processes of steps S106, S108, and S110 of the routine shown in FIG. 5 to achieve the "estimating means" in the first aspect of the present invention, and the process of step S112 of the routine shown in FIG. 5 to achieve the "control means" in the first aspect of the present invention, respectively.

Additionally, in the first embodiment described heretofore, the in-cylinder pressure sensor 5 corresponds to the "in-cylinder pressure sensor" of the first second of the present invention. Additionally, in the first embodiment described above, the arithmetic processing unit 20 performs the process of step S106 of the routine shown in FIG. 5 to achieve the "peak point-in-time identifying means" in the third aspect of the present invention, the process of step S108 to achieve the "identification information acquisition means" in the third aspect of the present invention, and the process of step S110 to achieve the "calculating means" in the third aspect of the present invention, respectively.

In addition, in the first embodiment described above, the arithmetic processing unit 20 performs the process of step S104 of the routine shown in FIG. 5 to achieve the "determining means" in the sixth aspect of the present invention.

Effects Obtained in the First Embodiment

Figure 6:
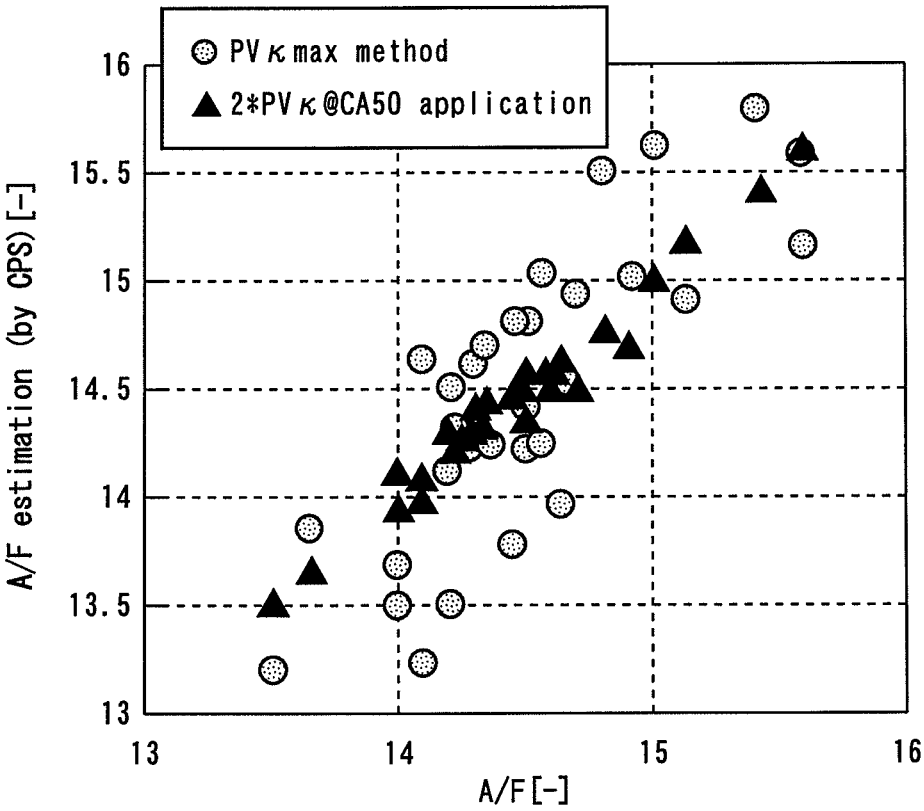
FIG. 6 is a chart for illustrating effects obtained in the first embodiment of the present invention.

FIG. 6 is a chart for illustrating effects obtained in the first embodiment of the present invention, showing results of verification made of air-fuel ratio detecting accuracy in a catalyst warm-up operation. FIG. 6 shows measurement points according to a "PVκmax method" and those according to "2*PVκ@CA50 application". The ordinate represents values of the air-fuel ratio presumptively obtained by using the output values of the in-cylinder pressure sensor (CPS). The measurement points according to the "PVκmax method" are the results of air-fuel ratios detected by using the quantity of heat generated obtained from the relation of "$Q=\Delta PV^{\kappa}_{max}$" as described in step S114 of the routine of FIG. 5. The measurement points according to the "2*PVκ@CA50 application" are the results of air-fuel ratios detected by using the quantity of heat generated obtained based on the relation of "$Q=2\times\Delta PV^{\kappa}_{CA50}$" according to the first embodiment. FIG. 6 reveals that the "2*PVκ@CA50 application" offers a linear characteristic that accurately corresponds to actual air-fuel ratios even in the catalyst warm-up operation.

The following technical background was also taken into consideration for the control apparatus according to the first embodiment. Manufacturers are now developing in-cylinder pressure sensors for systems responding to future fuel efficiency and emissions standards that will become even more stringent. Some of these have already been put into practical use. Mounting an in-cylinder pressure sensor permits precise and delicate combustion control and accurate parameter detection. This enables improved engine control performance.

A technique for detecting the combustion air-fuel ratio is known, to which the in-cylinder pressure sensor is applied (see, for example, JP-A-2006-144643). Such a technique enables more accurate detection of air-fuel ratios on a real-time basis, as compared with the conventional air-fuel ratio detecting method using the air-fuel ratio sensor. If the combustion extends from a latter part of the expansion stroke to an early part of the exhaust stroke as described earlier, however, it becomes difficult to detect the air-fuel ratio based on the output value of the in-cylinder pressure sensor. In this respect, this embodiment achieves real-time and accurate detection of the air-fuel ratio using the in-cylinder pressure sensor, while inhibiting harmful effects that are involved in the retarded combustion condition.

For each of the cases (1) to (3) listed below, respective benefits described thereunder can be enjoyed.

(1) Control Configuration not Limiting the Operating Condition is Allowed.

The embodiment allows the quantity of heat normally generated to be estimated even in catalyst warm-up retard, specifically, if the end of combustion is delayed to a point in time near the exhaust valve opening (EVO) or even later than that ("excessively retarded combustion"). This offers a benefit of permitting a control configuration not limiting the operating condition.

In internal combustion engine control in conventional gasoline engines, for example, the air-fuel ratio feedback control cannot be performed while the catalyst is being warmed up, because the air-fuel ratio sensor is yet to be activated. The technique according to this embodiment, however, permits precise and delicate air-fuel ratio feedback control even in the catalyst warm-up range, thus improving emissions. As a result, the air-fuel ratio can be detected throughout the entire operating range, so that the air-fuel ratio sensor can be eliminated to achieve a air-fuel ratio detecting function integrating the in-cylinder pressure sensor. Reduction in system cost can, as a result, be achieved.

Benefits of case (2) and case (3) described below can also be derived from using the quantity of heat generated or the parameter $PV^{\kappa}$ correlating therewith up to the position of the center of gravity of combustion.

(2) Effect of Noise is Small.

The first embodiment uses $PV^{\kappa}$ for the parameter correlating with the quantity of heat generated. With $PV^{\kappa}$, $V^{\kappa}$ superimposes more noise on the output of the in-cylinder pressure sensor at points farther away from TDC. A search for an end point of combustion farther away from the TDC at which the quantity of heat generated is the greatest is therefore more susceptible to noise.

A calculation interval for the quantity of heat generated may then be delimited before the position of the center of gravity of combustion ($\theta_{CA50}$ in the first embodiment). Specifically, the arithmetic processing unit 20 may limit the calculation interval or use permission interval of $PV^{\kappa}$ to a predetermined crank angle ($\theta_{CA50}$ in the first embodiment) according to the position of the center of gravity of combustion. The estimate can then be less susceptible to effect of noise. In such a modified example, too, the first embodiment allows the quantity of heat generated thereafter to be presumptively obtained as long as the in-cylinder pressure sensor output value up $\theta_{CA50}$ is available.

The arrangement for limiting the calculation interval of the quantity of heat generated ($PV^{\kappa}$ calculation interval or use permission interval) described above corresponds to the "exclusion means" in the fifth aspect of the present invention.

(3) Effect of a Thermal Strain Error of the in-Cylinder Pressure Sensor is Small.

Retarded combustion involves a long combustion period (specifically, it has a slow combustion speed). Accordingly, the lower the speed, the longer the in-cylinder pressure sensor is exposed to a combustion gas per unit time. This results in the in-cylinder pressure sensor producing a thermal strain error.

The effect of the thermal strain error is relatively small before the position of the center of gravity of combustion. In this respect, the first embodiment uses the in-cylinder pressure sensor output value up to the position of the center of gravity of combustion ($\theta_{CA50}$ in the first embodiment), so that an adverse effect from the thermal strain error can be avoided.

In the first embodiment, the total quantity of heat generated Q is calculated by multiplying $\Delta PV^{\kappa}_{CA50}$ by 2. The present invention is not, however, limited only to this. By using the relation that the combustion proportion is 50% when the rate of change in the quantity of heat generated is the greatest, the future information on the quantity of heat generated, specifically, the quantity of heat generated after $\theta_{CA50}$ (e.g. information on 70%, 80%, or 90% of the total quantity of heat generated Q) may be estimated, in addition to the quantity of heat generated at the end of combustion. In this case, considering that $\Delta PV^{\kappa}_{CA50}$ multiplied by 2 corresponds to the total quantity of heat generated Q, the arithmetic processing unit 20 may be made to multiply $\Delta PV^{\kappa}_{CA50}$ by a constant as appropriately. Or, with a function (e.g. a map of coefficient), instead of a predetermined numeric value, appropriately prepared in advance, the arithmetic processing unit 20 may be made to multiply $\Delta PV^{\kappa}_{CA50}$ by the output value of the function. These arithmetic operations also allow the estimated value of the quantity of heat generated to be obtained by multiplying $\Delta PV^{\kappa}_{CA50}$ by a predetermined value based on the relation that the combustion proportion is 50% when the rate of change in the quantity of heat generated is the greatest.

Additionally, in the first embodiment, $\Delta PV^{\kappa}_{CA50}$ is multiplied by 2; however, the present invention is not limited to the form of calculation in which $\Delta PV^{\kappa}_{CA50}$ is strictly multiplied by 2. A predetermined, substantially twofold coefficient may be established by following guidelines that $\Delta PV^{\kappa}_{CA50}$ multiplied by 2 corresponds to the total quantity of heat generated Q and $\Delta PV^{\kappa}_{CA50}$ may be multiplied by this predetermined coefficient. This is because of the following reason: specifically, the quantity of heat generated can be presumptively found in the same manner as in the first embodiment by calculating the quantity of heat generated at the end of combustion based on a value that is the double of $\Delta PV^{\kappa}_{CA50}$ even if the specific calculation technique is changed in its form.

The quantity of heat generated presumptively found in this embodiment may be used for other purposes, in addition to finding the combustion air-fuel ratio. The quantity of heat generated found in this embodiment can be used for detecting fuel properties, such as alcohol concentration, on the assumption that the quantity of heat generated/fuel injection amount is proportional ($\propto$) to a lower heat value. Note that, in this modified example, the "process for detecting alcohol concentration on the assumption that the quantity of heat generated/fuel injection amount is proportional ($\propto$) to the lower heat value" corresponds to the "property detecting means" in the eighth aspect of the present invention.

Second Embodiment

Figure 7:
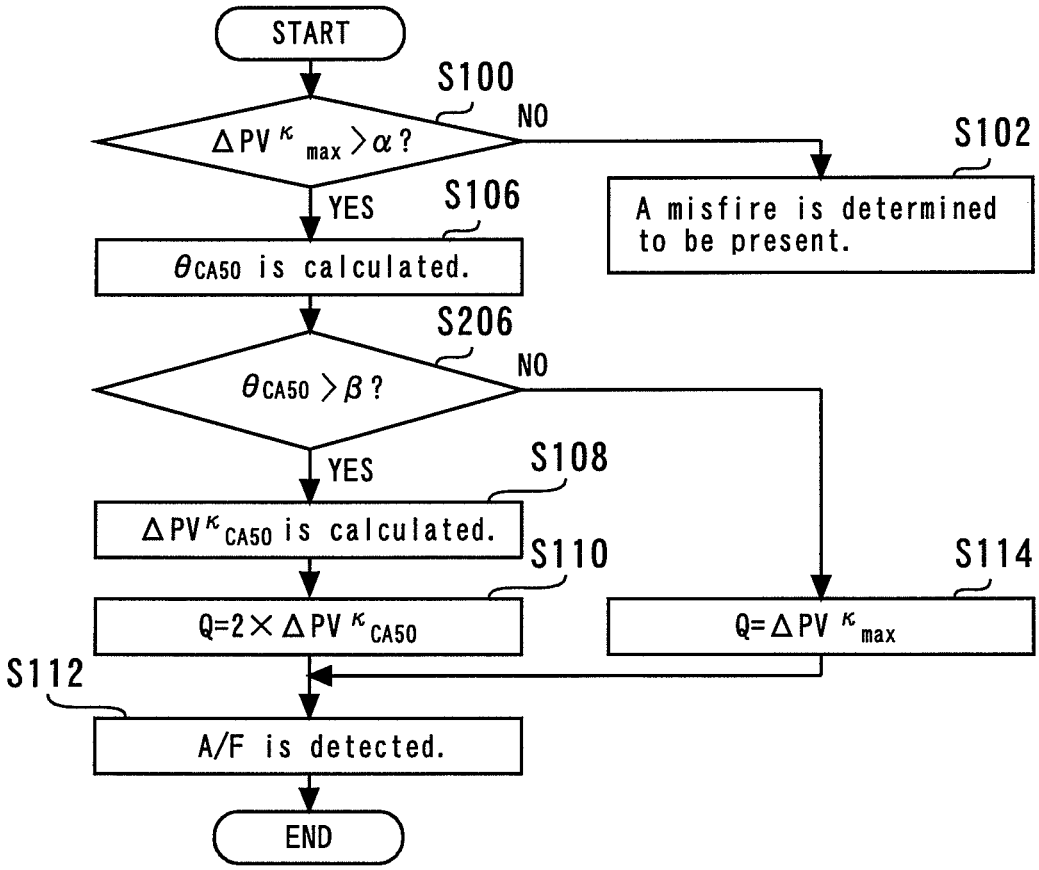
FIG. 7 is a flow chart showing a routine performed by the arithmetic processing unit 20 in the first embodiment of the present invention.

Hardware configuration and software configuration of a second embodiment of the present invention are basically the same as those in the first embodiment, except that a control unit according to the second embodiment is capable of performing a routine shown in FIG. 7. To avoid duplication, descriptions that follow may be omitted or simplified as appropriately.

Retarded combustion can accidentally occur, if normal combustion is deviated to run into an unstable combustion range in a large-volume external EGR or lean burn. In the second embodiment, therefore, $\theta_{CA50}$ is monitored at all times, instead of determining whether or not the catalyst warm-up retard control is being performed, to thereby estimate the heat value based on $\Delta PV^{\kappa}_{CA50}$ in a combustion cycle that is retarded than a predetermined value.

Specific processes performed in the control apparatus for the internal combustion engine according to the second embodiment will be described below with reference to FIG. 7. FIG. 7 is a flow chart showing a routine performed by an arithmetic processing unit 20 in the second embodiment of the present invention. The flow chart of FIG. 7 represents that of FIG. 5 from which the process of step S104 is deleted and to which a process of step S206 is instead added. Like processes are identified by the same step numbers as in FIG. 5 and the detailed description thereof will be simplified or omitted.

In the routine shown in FIG. 7, a process of step S100 is first performed as in the first embodiment. If a condition of step S102 is not met, a misfire is determined to be present in step S102 as in the first embodiment.

If the condition of step S100 is met, a process for calculating $\theta_{CA50}$ according to the first embodiment (step S106) is performed.

Next, it is determined whether or not $\theta_{CA50}$ greater than a predetermined value $\beta$ (step S206). If the condition of this step is not met, it is determined that the retarded combustion with which the second embodiment is primarily concerned does not occur. Accordingly, the process proceeds in sequence to steps S114 and S112 and, after the air-fuel ratio is detected, the current routine is terminated.

If the condition of step S206 is met, in contrast, it can be determined that the retarded combustion with which the second embodiment is concerned occurs. In this case, the process proceeds to steps S108 and S110 to thereby calculate the estimated value of the quantity of heat generated using $\Delta PV^{\kappa}_{CA50}$. The estimated quantity of heat generated is then used to detect the combustion air-fuel ratio (step S112), which terminates the current routine.

Through the foregoing processes, the determination process of step S206 allows the quantity of heat generated at the end of combustion to be reliably used for the control of the internal combustion engine, even when the end of combustion is retarded.

In the second embodiment described above, the arithmetic processing unit 20 performs the process of step S206 to achieve the "determining means" in the sixth aspect of the present invention.

The determination of whether the end of combustion is retarded or not may be made by, for example, the following methods.

(i) if the Amount of EGR (Exhaust Gas Recirculation) Exceeds a Predetermined Value:

Specifically, it may be determined whether the end of combustion is delayed or not, or is likely to be delayed or not, based on whether or not the opening of an EGR valve 12 is equal to or more than a predetermined value. Alternatively, it may be determined whether the end of combustion is delayed or not, or is likely to be delayed or not, based on, for example, whether or not an actual EGR amount as calculated is equal to or more than a predetermined value. In this case, the determination may be made if the end of combustion is retarded or not such that degraded accuracy of calculating the quantity of heat generated based on $\Delta PV^{\kappa}_{max}$ according to step S114 poses a problem.

(ii) if the Internal Combustion Engine is Performing Lean Burn:

Specifically, a routine may be performed to determine whether or not the lean burn is currently performed based on information on various control parameters, such as currently controlled air-fuel ratio of the engine. In this case, the determination may be made if the end of combustion is retarded or not such that degraded accuracy of calculating the quantity of heat generated based on $\Delta PV^{\kappa}_{max}$ according to step S114 poses a problem.

The techniques of (i) and (ii) above, the determination of catalyst warm-up operation according to the first embodiment, and the determination of $\theta_{CA50}$ relative to the predetermined value according to the second embodiment may be used individually or in combination.

The invention claimed is:

1. An apparatus for controlling an internal combustion engine, comprising:

acquisition means for acquiring, as a value representing information on the quantity of heat generated, a quantity of heat generated by the internal combustion engine or a parameter correlating with the quantity of heat generated;

based on a value obtained by multiplying the quantity-of-heat-generated information value at a timing at which a rate of change in the quantity-of-heat-generated information value is a maximum value thereof and a predetermined value together, estimating means for estimating a quantity of heat generated after the timing; and controlling means for controlling the internal combustion engine by using the quantity of heat generated after the timing estimated with the estimating means.

2. The apparatus according to claim 1, wherein:

the acquisition means includes:

means for acquiring an output from an in-cylinder pressure sensor attached to the internal combustion engine; and means for acquiring the quantity of heat generated or the parameter based on the output of the in-cylinder pressure sensor acquired by the sensor output acquisition means.

3. The apparatus according to claim 1, wherein:

the acquisition means includes:

means for acquiring the quantity-of-heat-generated information value at predetermined intervals during operation of the internal combustion engine; and the estimating means includes:

means for identifying, through detection or estimation, a peak point in time at which the rate of change in the quantity-of-heat-generated information value is the maximum value thereof;

means for acquiring, of the quantity-of-heat-generated information values acquired by the acquisition means during the operation of the internal combustion engine, a value at the peak point in time identified by the peak-point-in-time identifying means; and means for finding the quantity of heat generated after the peak point in time through a calculation using the quantity-of-heat-generated information value acquired by the identification information acquisition means and a predetermined coefficient.

4. The apparatus according to claim 3, wherein:

the calculating means includes:

means for finding a quantity of heat generated at an end of combustion based on a value twice as much as the quantity-of-heat-generated information value at the peak point in time identified by the peak-point-in-time identifying means.

5. The apparatus according to claim 3, wherein:

the calculating means includes:

means for excluding, from a numeric value used for the calculation for finding the quantity of heat generated, the quantity-of-heat-generated information value acquired by the identification information acquisition means after a predetermined timing before the end of combustion in the internal combustion engine.

6. The apparatus according to claim 1, further comprising:

means for determining whether or not the end of combustion in the internal combustion engine is delayed, or likely to be delayed, relative to a predetermined timing, wherein:

the controlling means controls the internal combustion engine by using the quantity of heat generated acquired by the acquisition means, when the determining means determines that the end of combustion is delayed or likely to be delayed relative to the predetermined timing.

7. The apparatus according to claim 6, wherein:

the determining means determines that the end of combustion in the internal combustion engine is delayed, or likely to be delayed, relative to the predetermined timing when at least one of following is true: retard of the internal combustion engine is equal to, or more than, a predetermined value; the internal combustion engine is in a process of catalyst warm-up operation; an amount of exhaust gas recirculation (EGR) in the internal combustion engine is equal to, or more than, a predetermined value; and the internal combustion engine is in lean-burn operation.

8. The apparatus according to claim 1, wherein:

the controlling means includes at least:

means for detecting an air-fuel ratio during combustion in the internal combustion engine by using the quantity of heat generated after the timing estimated by the estimating means; or means for detecting properties of fuel of the internal combustion engine by using the quantity of heat generated after the timing estimated by the estimating means.

9. An apparatus for controlling an internal combustion engine, comprising:

a controller having control logic configured to:

(i) acquire, as a value representing information on the quantity of heat generated, a quantity of heat generated by the internal combustion engine or a parameter correlating with the quantity of heat generated;

(ii) based on a value obtained by multiplying the quantity-of-heat-generated information value at a timing at which a rate of change in the quantity-of-heat-generated information value is a maximum value thereof and a predetermined value together, estimate a quantity of heat generated after the timing; and (iii) control the internal combustion engine by using the quantity of heat generated after the timing estimated with the estimation.

10. The apparatus according to claim 9, wherein:

the acquiring the quantity of heat generated or the parameter includes:

acquiring the quantity-of-heat-generated information value at predetermined intervals during operation of the internal combustion engine; and the estimating of the quantity of heat generated after the timing includes:

identifying, through detection or estimation, a peak point in time at which the rate of change in the quantity-of-heat-generated information value is the maximum value thereof;

acquiring, of the quantity-of-heat-generated information values acquired by the acquisition unit during the operation of the internal combustion engine, a value at the peak point in time; and finding the quantity of heat generated after the peak point in time through a calculation using the quantity-of-heat-generated information value and a predetermined coefficient.

11. The apparatus according to claim 10, wherein:

the calculating of the quantity of heat generated after the peak point in time includes:

finding a quantity of heat generated at an end of combustion based on a value twice as much as the quantity-of-heat-generated information value at the peak point in time.

12. The apparatus according to claim 10, wherein:

the calculating of the quantity of heat generated after the peak point in time includes:

excluding, from a numeric value used for the calculation for finding the quantity of heat generated, the quantity-of-heat-generated information value after a predetermined timing before the end of combustion in the internal combustion engine.

13. The apparatus according to claim 9, wherein:

the controller having control logic is configured to:

(iv) determine whether or not the end of combustion in the internal combustion engine is delayed, or likely to be delayed, relative to a predetermined timing:

the controlling of the internal combustion engine includes:

controlling the internal combustion engine by using the quantity of heat generated when the end of combustion is delayed or likely to be delayed relative to the predetermined timing.

14. The apparatus according to claim 13, wherein:

the determining whether or not the end of combustion in the internal combustion engine is delayed, or likely to be delayed, relative to the predetermined timing, includes: determining that the end of combustion in the internal combustion engine is delayed, or likely to be delayed, relative to the predetermined timing when at least one of following is true: retard of the internal combustion engine is equal to, or more than, a predetermined value; the internal combustion engine is in a process of catalyst warm-up operation; an amount of exhaust gas recirculation (EGR) in the internal combustion engine is equal to, or more than, a predetermined value; and the internal combustion engine is in lean-burn operation.

15. The apparatus according to claim 9, wherein:

the controlling of the internal combustion engine includes at least:

for detecting an air-fuel ratio during combustion in the internal combustion engine by using the quantity of heat generated after the timing by the estimation; or detecting properties of fuel of the internal combustion engine by using the quantity of heat generated after the timing by the estimation.

16. The apparatus according to claim 1, further comprising:

determining means for determining whether or not the end of combustion in the internal combustion engine is delayed, or likely to be delayed relative to a predetermined timing wherein:

the acquisition means acquires the quantity-of-heat-generated information value at predetermined intervals during operation of the internal combustion engine, the controlling means controls the internal combustion engine by using the quantity of heat generated acquired by the estimating means, when the determining means determines that the end of combustion is delayed or likely to be delayed relative to the predetermined timing, and the controlling means controls the internal combustion engine by using the quantity-of-heat-generated information value acquired by the acquisition means, when the determining means determines that the end of combustion is not delayed or likely not to be delayed relative to the predetermined timing.

17. The apparatus according to claim 9, wherein:

the acquiring of the quantity of heat generated or the parameter includes:

acquiring an output from an in-cylinder pressure sensor attached to the internal combustion engine; and acquiring the quantity of heat generated or the parameter based on the output of the in-cylinder pressure sensor.

18. The apparatus to claim 9, wherein the controller having control logic is configured to:

(iv) determine whether or not the end of combustion in the internal combustion engine is delayed, or likely to be delayed, relative to a predetermined timing, wherein the acquiring of the quantity of heat generated or the parameter includes:

acquires the quantity-of-heat-generated information value at predetermined intervals during operation of the internal combustion engine, the controlling the internal combustion engine includes:

controlling the internal combustion engine by using the quantity of heat generated acquired by the estimating unit, when the determining unit determines that the end of combustion is delayed or likely to be delayed relative to the predetermined timing, and controlling the internal combustion engine by using the quantity-of-heat-generated information value acquired by the acquisition unit, when the determining unit determines that the end of combustion is not delayed or likely not to be delayed relative to the predetermined timing.

19. A controller-implemented method of controlling an internal combustion engine, the method comprising:

acquiring, as a value representing information on the quantity of heat generated, a quantity of heat generated by the internal combustion engine or a parameter correlating with the quantity of heat generated;

based on a value obtained by multiplying the quantity-of-heat-generated information value at a timing at which a rate of change in the quantity-of-heat-generated information value is a maximum value thereof and a predetermined value together, estimating a quantity of heat generated after the timing; and controlling the internal combustion engine by using the quantity of heat generated after the timing estimated with the estimation.

* * * * *